US008727111B2

(12) United States Patent
Schlegel

(10) Patent No.: US 8,727,111 B2
(45) Date of Patent: May 20, 2014

(54) PACKAGING FOR OBJECTS THAT HAVE A PORTION OF LIQUID

(76) Inventor: Tobias Schlegel, Waldkirch (DE)

( * ) Notice: Subject to any disclaimer, the term of this patent is extended or adjusted under 35 U.S.C. 154(b) by 0 days.

(21) Appl. No.: 13/583,660

(22) PCT Filed: Mar. 21, 2011

(86) PCT No.: PCT/DE2011/000288

§ 371 (c)(1),
(2), (4) Date: Sep. 10, 2012

(87) PCT Pub. No.: WO2011/113427

PCT Pub. Date: Sep. 22, 2011

(65) Prior Publication Data

US 2013/0001106 A1 Jan. 3, 2013

(30) Foreign Application Priority Data

Mar. 19, 2010 (DE) ..... 10 2010 012 189

(51) Int. Cl.

| | |
|---|---|
| ***B65D 81/26*** | (2006.01) |
| ***B65D 5/50*** | (2006.01) |
| ***A23B 4/10*** | (2006.01) |
| ***B65B 31/02*** | (2006.01) |

(52) U.S. Cl.

USPC ..... 206/204; 426/119; 426/125; 426/129; 426/404

(58) Field of Classification Search

CPC .. B65D 81/261; B65D 81/262; B65D 81/264; B65D 81/265; B65D 77/00; B65D 77/003

USPC ..... 206/204, 557; 229/407; 426/124, 129, 426/106, 119, 396, 132, 133, 404, 411, 410

See application file for complete search history.

(56) References Cited

U.S. PATENT DOCUMENTS

| | | | | |
|---|---|---|---|---|
| 3,026,209 | A * | 3/1962 | Niblack et al. | 426/124 |
| 3,040,947 | A * | 6/1962 | Reifers et al. | 229/407 |
| 3,515,331 | A * | 6/1970 | Guthrie, Sr. | 229/103.11 |
| 4,861,632 | A | 8/1989 | Caggiano | |
| 5,135,787 | A * | 8/1992 | Bair | 428/36.1 |
| 5,720,999 | A * | 2/1998 | Lanzani et al. | 426/129 |
| 6,095,325 | A * | 8/2000 | Simhaee | 206/204 |

(Continued)

FOREIGN PATENT DOCUMENTS

| | | |
|---|---|---|
| EP | 2 107 010 | 10/2009 |
| WO | WO 2009/020805 | 2/2009 |

OTHER PUBLICATIONS

International Search Report of PCT/DE2011/000288, date of mailing Jul. 20, 2011.

*Primary Examiner* — Steven A. Reynolds
*Assistant Examiner* — Javier A Pagan
(74) *Attorney, Agent, or Firm* — Collard & Roe, P.C.

(57) ABSTRACT

Proposed is a package for objects that have a portion of liquid, comprising a container (1) which consists of a liquid-impermeable material for receiving the object (9) and a dimensionally stable hollow body (10, 13, 15) which has at least one opening (12, 14, 16) and is arranged in the container (1) and receives the liquid that escapes from an object (9) arranged in the container (1).

14 Claims, 4 Drawing Sheets

(56) References Cited

U.S. PATENT DOCUMENTS

Figure 1:
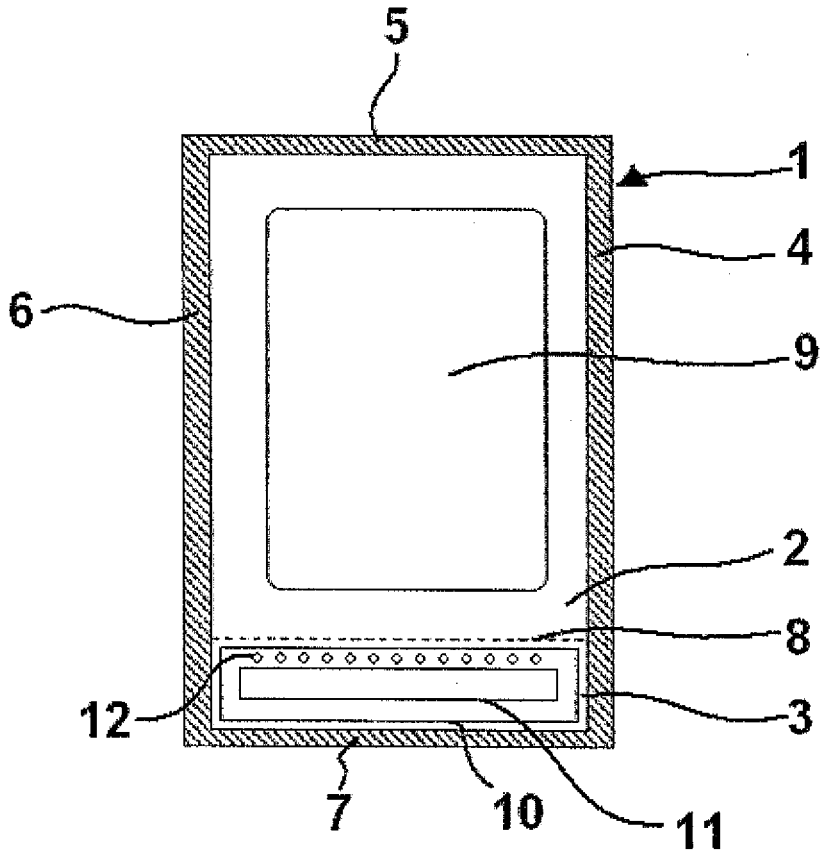

| | | | | |
|---|---|---|---|---|
| 6,152,295 | A * | 11/2000 | Brander et al. | 206/204 |
| 6,216,855 | B1 * | 4/2001 | Grone | 206/204 |
| 6,298,983 | B1 | 10/2001 | Yeager | |
| 6,478,147 | B1 * | 11/2002 | Brander et al. | 206/204 |
| 6,482,452 | B1 * | 11/2002 | Weller et al. | 426/129 |
| 7,776,416 | B2 * | 8/2010 | Kinard et al. | 428/36.1 |
| 2003/0126710 | A1 * | 7/2003 | Policicchio et al. | 15/228 |
| 2009/0145783 | A1 * | 6/2009 | Forker | 206/204 |

* cited by examiner

PACKAGING FOR OBJECTS THAT HAVE A PORTION OF LIQUID

CROSS REFERENCE TO RELATED APPLICATIONS

This application is the National Stage of PCT/DE2011/000288 filed on Mar. 21, 2011, which claims priority under 35 U.S.C. §119 of German Application No. 10 2010 012 189.4 filed on Mar. 19, 2010, the disclosure of which is incorporated by reference. The international application under PCT article 21(2) was not published in English.

PRIOR ART

The invention relates to a package for objects that have a proportion of liquid, with a flexible or dimensionally stable container which consists of a liquid-impermeable material.

Such objects include, for example, foodstuffs or other food products, plants or parts of plants and man-made objects. In retail shops based on self-service foodstuffs such as meat, fish, poultry and vegetables are offered for sale in packaged portions. As a package may serve, for example, containers made of at least partially transparent plastic film or dimensionally stable dishes or trays that are covered by a transparent plastic film. The containers have the advantage that the potential buyer can view the correspondingly packed goods and can ascertain the most important characteristics of the goods for him from a printed label on the package. The goods can be selected without the assistance of a salesperson. A disadvantage of such a package has proven to be that food products such as meat, fish, poultry and some cooked vegetables secrete liquid that makes a negative visual impression when the correspondingly packed goods are considered. Furthermore, the contact of the liquid with the foodstuff favours the growth of bacteria in the package. In order to counteract this, absorbent pads and absorbent bodies that are placed under the goods in the package are known. However, these have the disadvantage that they are limited in their ability to absorb liquid. Furthermore, excess liquid that is not absorbed once the absorbent pad reaches saturation remains in contact with the foodstuff. Moreover, the sight of an absorbent body filled with liquid is unpleasant for the buyer when he removes the foodstuff from the package upon opening. Since the liquid emerging from the foodstuff is normally not colourless, it is visible in the absorbent pad.

Furthermore, known packages made from a flexible material and equipped with an absorbent element have the disadvantage that when a vacuum is generated in the package in order to establish a vacuum pack, the flexible package material adheres to the absorbent element and restricts the ability of the absorbent element to absorb the liquid.

By contrast, the object of the invention is to provide a package whereby direct contact between the object to be packed and the liquid escaping from it is avoided and with which a vacuum pack can be created.

THE INVENTION AND ITS ADVANTAGES

The package according to the invention with the features of claim 1 is characterised in that a container made from a liquid-impermeable material is equipped with a dimensionally stable hollow body. The dimensionally stable hollow body is located in the container. There may, for instance, be provided a first section of the container which serves to receive the object to be packed. In this case a second section of the container serves to receive the dimensionally stable hollow body. The stability of the hollow body in respect of its form is such that the hollow body withstands the vacuum required to create a vacuum pack and its form changes only slightly or not at all. The dimensionally stable hollow body thus ensures a cavity that remains even when a vacuum is generated in the container and the flexible package material of the container adheres to the object to be packed and to the hollow body. The liquid escaping from the object collects in the cavity even under vacuum. This is in particular the case if the container is arranged such that the object is located above the dimensionally stable hollow body. However, the collection of the liquid in the hollow body is favoured even if the object and the hollow body are located at the same level.

The dimensionally stable hollow body is proportioned by its volume such that it can receive the volume of the liquid escaping from the object to be packed.

The dimensionally stable hollow body has at least one opening through which a liquid can penetrate the cavity of the hollow body in order to be stored there. The opening can be designed to be circular, oval or cornered. If several openings are provided, these may be all the same size or of different sizes. They may have all the same form or different forms.

The liquid escaping from the object to be packed collects in the dimensionally stable hollow body. The tendency of the liquid to move into the interior of the hollow body is greater than in the reverse direction. This process is assisted by a suitable arrangement of the package. It is further favoured by the pressure conditions in the package. This prevents direct contact between the object to be packed and the liquid escaping from it and collecting in the hollow body.

The flowing towards the hollow body of a liquid escaping from the object is assisted by a vertical orientation of the package with the packed object above the dimensionally stable hollow body. The flowing of the liquid in the opposite direction is prevented by the orientation of the package.

The package is further observed to have the effect that the air that remains in the vacuum pack after sealing despite the generation of a vacuum collects in the dimensionally stable hollow body. This air migrates to the hollow body from the section receiving the packed object. This effect has the advantage that the quantity of oxygen at the surface of the packed object is reduced further and the growth of bacteria is additionally restricted.

The container has the advantage that it can be suspended and thereby oriented vertically in order to assist the flowing under the effect of gravity of the liquid escaping from the object in the direction of the hollow body. This arrangement also has the advantage that the goods contained in the package can be suspended and presented to the customers in a self-service store.

The dimensionally stable hollow body can be either loosely accommodated in the container or attached to the container. Furthermore, the container can be equipped with a liquid-permeable partition that separates a first section receiving the object to be packed from a second section accommodating the hollow body. The partition ensures that there is always a gap between the object and the hollow body and that the object and the hollow body cannot come arbitrarily close to each other.

According to an advantageous embodiment of the invention, the dimensionally stable hollow body has a longitudinal form. It may for instance have the form of a circular cylinder or a cuboid. The longitudinal hollow body extends for example along one side of a rectangular package. As an alternative for the longitudinal form, the dimensionally stable body may also have the form of a sphere or ellipsoid.

According to a further advantageous embodiment of the invention, the dimensionally stable hollow body is composed of plastic. It can thus be easily and cost-efficiently manufactured in any form and size and has a low weight. Biologically degradable plastics known as bioplastics may also be used. In addition, the hollow body may be composed of a naturally occurring material such as bamboo, for instance.

According to a further advantageous embodiment of the invention, the hollow body has at least one structure supporting the hollow body to the inside. The structure prevents the walls of the hollow body from bulging too much to the inside under the effect of the suction produced in the generation of a vacuum for vacuum packs. This applies in particular if the hollow body has thin walls. Such thin walls allow production costs to be reduced and ensure a low weight. The supporting structure may consist for instance of one or more dividers in the interior of the hollow body. The dividers may connect opposite walls of the hollow body with each other.

According to a further advantageous embodiment of the invention, the dimensionally stable hollow body has on or near its opening at least one projection protruding towards the outside. This prevents the flexible material of the container from adhering to the opening when a vacuum is generated for vacuum packs. If the container adheres to the opening, the opening is at least partially sealed. This impairs the ingress of liquid into the hollow body.

According to a further advantageous embodiment of the invention, the opening in the dimensionally stable hollow body is designed in a funnel shape, whereby the opening cross-section on the inner side of the hollow body is smaller than that on the outer side of the hollow body. This form of opening favours the ingress of liquid into the hollow body and impairs the escape of liquid from the hollow body.

According to a further advantageous embodiment of the invention, the container consists preferably entirely or partially of plastic, for instance plastic film. Parts of the container may also consist of metal, cardboard, paper or composite materials. The basic component of the plastics is synthetic or semi-synthetically produced polymers with organic groups. Biologically degradable plastics known as bioplastics may also be used. These are produced from sustainable raw materials such as starch, oil, polylactic acid, polyhydroxybutyrate or cellulose.

According to a further advantageous embodiment of the invention, in the dimensionally stable hollow body is arranged at least one absorbent element which consists of a liquid-absorbing material that absorbs the liquid escaping from the object. In its interior the hollow body offers sufficient space for at least one absorbent element, so that this does not lose its ability to absorb liquid even in a vacuum. The liquid escaping from a packed object and collecting in the hollow body is kept in the absorbent element. Regardless of how the package is oriented, the flow of liquid back to the packed object is precluded. Furthermore, the liquid remains in the absorbent element even if the package is opened. It does not escape when the package is opened.

According to a further advantageous embodiment of the invention, the absorbent element contains fibres or fibre compositions, from for instance cellulose, rayon, other naturally occurring fibres or synthetic fibres. The fibres are processed into wadding, tissue, paper or nonwoven fabric. What are known as superabsorbents, which are additionally contained in the absorbent element, can enhance its ability to store liquid. The absorbent element may be adapted to the form of the dimensionally stable hollow body. The greater the volume of the absorbent element, the more liquid it can absorb and store. The absorbent element may be composed of several layers. It may also have liquid-absorbing granules as an alternative or in addition to the above materials.

According to a further advantageous embodiment of the invention, the container comprises an at least partially flexible pouch.

According to a further advantageous embodiment of the invention, the pouch consists entirely of a flexible plastic, for instance a plastic film. Such packages are characterised by their low weight and high flexibility in respect of adaptation to the objects to be packed.

According to a further advantageous embodiment of the invention, the container has a tray. This is preferably dimensionally stable, so that the tray does not deform on receiving the object to be packed. The dimensionally stable hollow body may be a constituent part of such a dimensionally stable tray. In this case the tray and hollow body may be created in one piece. They may both consist of the same dimensionally stable material.

According to a further advantageous embodiment of the invention, the container is at least partially transparent. This allows the packed object to be viewed from the outside.

According to a further advantageous embodiment of the invention, that section of the container that accommodates the dimensionally stable hollow body is equipped at least partially with a non-transparent cover or coating. This prevents sight of the absorbent element located there and any liquid that may be found there. A negative impression of the package by the potential buyer is thereby avoided.

Further advantages and advantageous embodiments of the invention can be obtained from the following description, the drawing and the claims.

DRAWING

Figure 2:
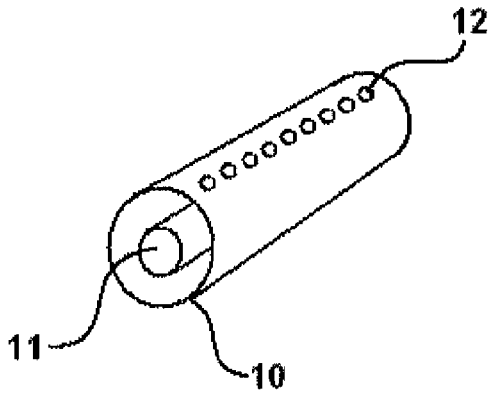
Figure 3:
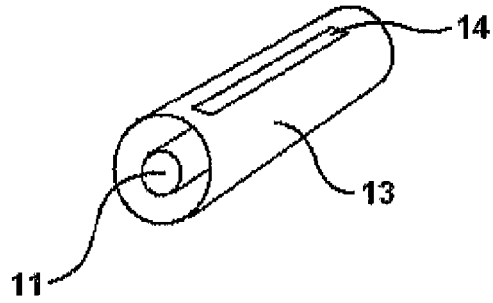
Figure 4:
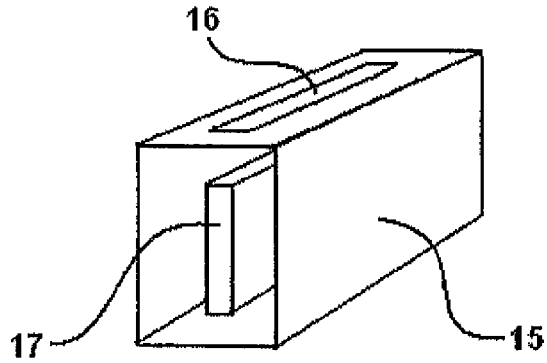
Figure 5:
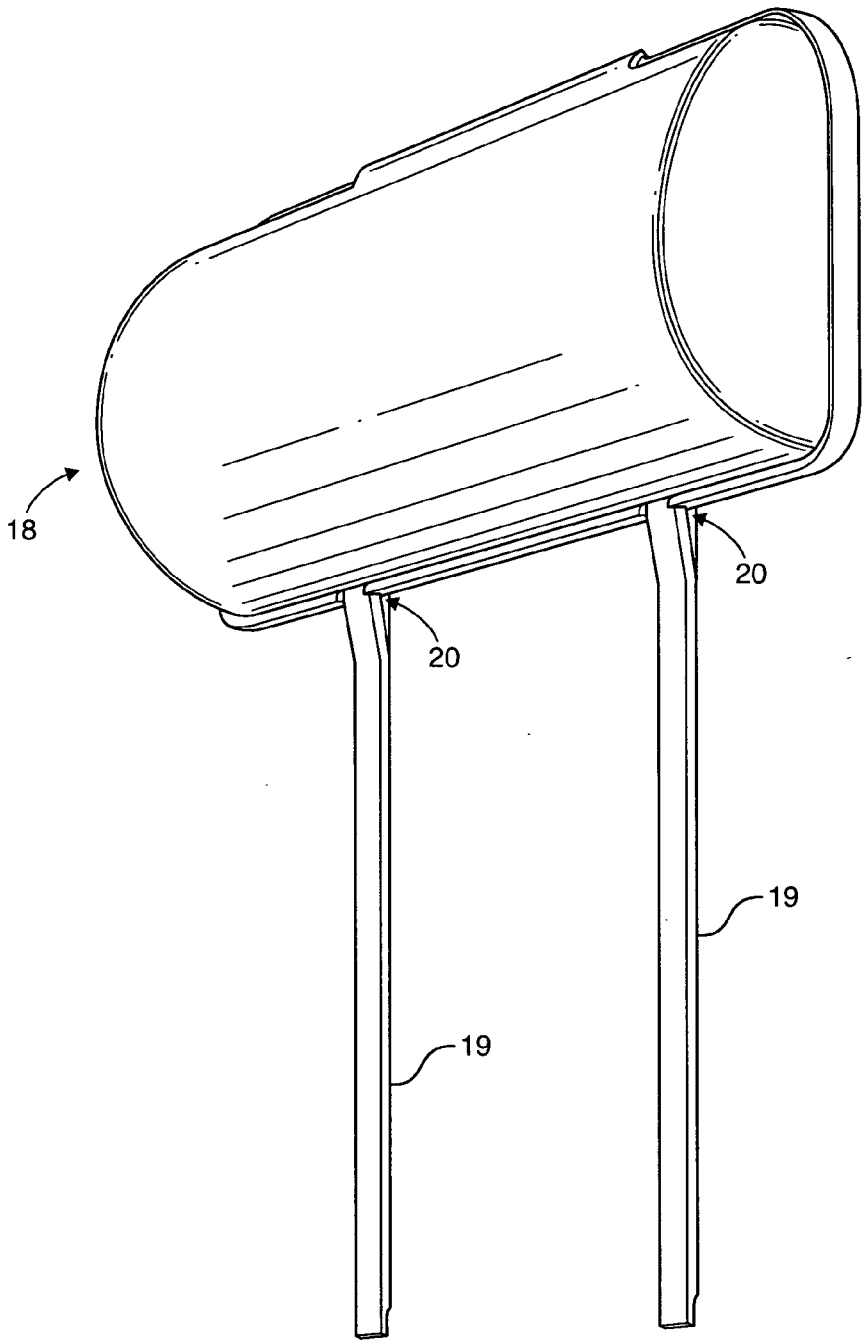
Figure 6:
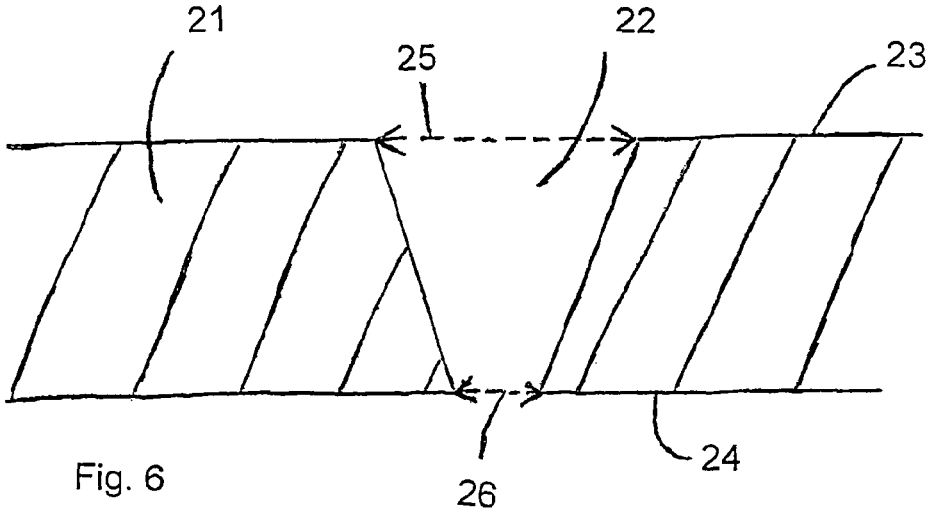
Figure 7:
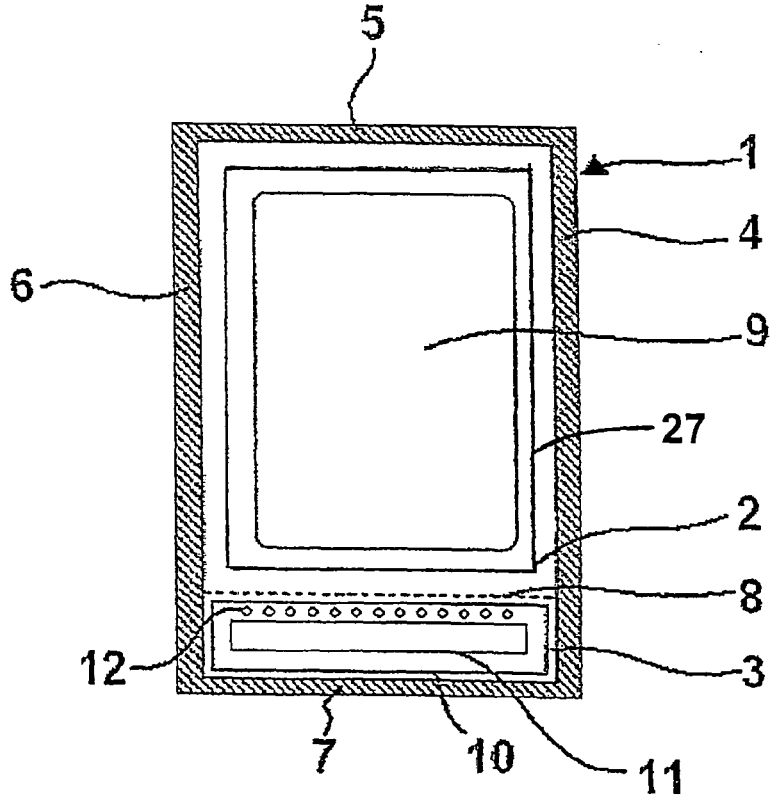

The drawing shows a model embodiment of the invention. Illustration:

FIG. 1 Package viewed from the front,

FIG. 2 Perspective view of the dimensionally stable hollow body of the package according to FIG. 1, FIG. 3 Perspective view of the second embodiment of a dimensionally stable hollow body for a package according to FIG. 1, FIG. 4 Perspective view of a third embodiment of a dimensionally stable hollow body for a package according to the invention, FIG. 5 Perspective view of a fourth embodiment of a dimensionally stable hollow body for a package according to the invention, FIG. 6 Cross-Sectional view through a wall of a fifth embodiment of a dimensionally stable hollow body for a package according to the invention, and FIG. 7 Front view of a further embodiment of a package according to the invention.

DESCRIPTION OF THE MODEL EMBODIMENT

FIG. 1 shows a package consisting of a container 1 in the form of a flexible pouch made of plastic film having a first area 2 and a second area 3. The plastic film forms the rear side and the front side of the container 1. The rear side and front side are fused together at the edges 4, 5, 6 and 7. The fused join is liquid- and airtight. The first area 2 and the second area 3 are separated from each other by a partition 8. The partition runs along a straight line. Along this line sections in which the two plastic films forming the front side and rear side of the container 1 are fused together alternate with sections that are not fused. In the first section foodstuff 9 is arranged. In the second area a dimensionally stable hollow body 10 in the form of a cylinder is arranged. The dimensionally stable hollow body 10 has the form of a circular cylinder. It is shown in a longitudinal section so that an absorbent element 11 arranged in the dimensionally stable hollow body is visible. The non-fused sections of the partition 8 form passages for the liquid that escapes from the foodstuff 9 and so can flow from the first area 2 to the second area 3. The liquid reaches the absorbent element 11 through openings 12 in the hollow body 10 and is kept in the absorbent element 11. The openings have a circular form. They are arranged on the side of the hollow body 10 that faces the first area. The flowing of the liquid from the first into the second area is supported by its own weight if the package, as illustrated in FIG. 1, is oriented with the first area 2 upwards and the second area 3 downwards.

FIG. 2 shows in perspective the dimensionally stable hollow body 10 with the circular openings 12 and the absorbent element 11.

FIG. 3 shows a second embodiment of a dimensionally stable hollow body 13. It differs from the first embodiment according to FIG. 2 in the form of the opening 14. In the second embodiment is provided a longitudinal opening 14 that extends along almost the entire length of the hollow body 10. The opening 14 has a rectangular form and is therefore formed as a slot. The hollow body 13 can be arranged in a container according to FIG. 1.

FIG. 4 shows a third embodiment of a dimensionally stable hollow body 15. The hollow body 15 has a longitudinal cuboid form and a longitudinal opening 16. The opening 16 is therefore formed as a slot like that of the hollow body 13 according to the second embodiment. In the hollow body 15 is arranged an absorbent element 17 that likewise has a cuboid form. The hollow body 15 can be arranged in a container according to FIG. 1.

According to a further embodiment of the hollow body shown in FIG. 5, the dimensionally stable hollow body 18 has the form of an ellipsoid and has projections 19 disposed near its openings 20. The projections 19 protrude towards the outside. These projections 19 prevent the flexible material of the container from adhering to the openings 20 when a vacuum is generated for vacuum packs. If the container adheres to the openings 20, the openings 20 are at least partially sealed. This would impair the ingress of liquid into the hollow body 18, and the projections 19 help avoid this impairment.

According to a further embodiment of the hollow body shown in FIG. 6, which section shows a cross section through the wall of the dimensionally stable hollow body 21, the opening 22 is designed in a funnel shape, whereby the opening cross-section 26 on the inner side 24 of the hollow body 21 is smaller than the opening cross-section 25 on the outer side 23 of the hollow body 21. This form of opening 22 favors the ingress of liquid into the hollow body 21 and impairs the escape of liquid from the hollow body 21.

According to a further embodiment of the invention shown in FIG. 7, the container 1 has a tray 27. The tray 27 is preferably dimensionally stable, so that the tray 27 does not deform on receiving the object 9 to be packed.

All features can be material to the invention both individually and in any combination.

LIST OF REFERENCE NUMBERS

1 Container
2 First area
3 Second area
4 Edge of the container
5 Edge of the container
6 Edge of the container
7 Edge of the container
8 Partition
9 Piece of meat
10 Dimensionally stable hollow body
11 Absorbent element
12 Opening in the dimensionally stable hollow body
13 Dimensionally stable hollow body
14 Opening
15 Dimensionally stable hollow body
16 Opening
17 Absorbent element

The invention claimed is:

1. A vacuum package for objects that have a portion of liquid, the vacuum package comprising:
an object having a portion of liquid,
a dimensionally stable hollow body, and
a sealed container comprising a flexible liquid-impermeable plastic film and a partition formed by the plastic film, the partition dividing the sealed container into a first area and a second area,
wherein the object is disposed in the first area and the dimensionally stable hollow body is disposed in the second area,
wherein the partition is liquid-permeable and provides a gap between the object and the dimensionally stable hollow body,
wherein the dimensionally stable hollow body has at least one opening, is arranged in the sealed container, and receives the liquid that escapes from the object arranged in the sealed container,
wherein the sealed container is under reduced pressure such that the plastic film adheres to the object, and
wherein the dimensionally stable hollow body has at least one projection protruding towards the outside on or near the at least one opening.

2. A vacuum package for objects that have a portion of liquid, the vacuum package comprising:
an object having a portion of liquid,
a dimensionally stable hollow body, and
a sealed container comprising a flexible liquid-impermeable plastic film and a partition formed by the plastic film, the partition dividing the sealed container into a first area and a second area,
wherein the object is disposed in the first area and the dimensionally stable hollow body is disposed in the second area,
wherein the partition is liquid-permeable and provides a gap between the object and the dimensionally stable hollow body,
wherein the dimensionally stable hollow body has at least one opening, is arranged in the sealed container, and receives the liquid that escapes from the object arranged in the sealed container, and
wherein the sealed container is under reduced pressure such that the plastic film adheres to the object.

3. The vacuum package according to claim 2, wherein the dimensionally stable hollow body has a longitudinal form.

4. The vacuum package according to claim 2, wherein the dimensionally stable hollow body has the form of a cylinder or cuboid.

5. The vacuum package according to claim 2, wherein the dimensionally stable hollow body has the form of a sphere or ellipsoid.

6. The vacuum package according to claim 2, wherein the dimensionally stable hollow body comprises plastic.

7. The vacuum package according to claim 2, wherein the dimensionally stable hollow body has at least one structure supporting the hollow body to the inside.

8. The vacuum package according to claim 2, wherein the at least one opening is designed in a funnel shape, and wherein an opening cross-section of the at least one opening on an inner side of the dimensionally stable hollow body is smaller than an opening cross-section of the at least one opening on an outer side of the dimensionally stable hollow body.

9. The vacuum package according to claim 2, wherein in the dimensionally stable hollow body is arranged at least one absorbent element comprising a liquid-absorbing material receiving the liquid escaping from the object.

10. The vacuum package according to claim 9, wherein the at least one absorbent element has several layers.

11. The vacuum package according to claim 9, wherein the at least one absorbent element has liquid-absorbing granules.

12. The vacuum package according to claim 2, wherein the sealed container forms an at least partially flexible pouch.

13. The vacuum package according to claim 2, wherein the sealed container has a tray.

14. A vacuum package for objects that have a portion of liquid, the vacuum package comprising:

an object having a portion of liquid, a dimensionally stable hollow body, and a sealed container comprising a flexible liquid-impermeable plastic film and a partition, wherein the partition divides the sealed container into a first area and a second area, wherein the flexible liquid-impermeable plastic film covers the object in the first area and covers the dimensionally stable hollow body in the second area, wherein the partition is liquid-permeable and provides a gap between the object and the dimensionally stable hollow body, wherein the dimensionally stable hollow body has at least one opening, is arranged in the sealed container, and receives the liquid that escapes from the object arranged in the sealed container, and wherein the sealed container is under reduced pressure such that the plastic film adheres to the object.

* * * * *